US008779273B2

(12) United States Patent
Han

(10) Patent No.: US 8,779,273 B2
(45) Date of Patent: Jul. 15, 2014

(54) POWER SUPPLY DEVICE FOR GUITAR

(75) Inventor: Man-Guen Han, Gyeonggi-do (KR)

(73) Assignee: Mi-Ran Kim, Gyeonggi-do (KR)

( * ) Notice: Subject to any disclaimer, the term of this patent is extended or adjusted under 35 U.S.C. 154(b) by 0 days.

(21) Appl. No.: 13/549,201

(22) Filed: Jul. 13, 2012

(65) Prior Publication Data

US 2013/0014632 A1 Jan. 17, 2013

(30) Foreign Application Priority Data

Jul. 13, 2011 (KR) ..... 10-2011-0069512

(51) Int. Cl.
*G10H 3/12* (2006.01)

(52) U.S. Cl.
USPC ..... 84/725; 84/726

(58) Field of Classification Search
USPC ..... 84/725–728
See application file for complete search history.

(56) References Cited

U.S. PATENT DOCUMENTS 4,002,994 A * 1/1977 Fender ..... 330/107
4,119,007 A * 10/1978 Criglar et al. ..... 84/730
4,526,082 A * 7/1985 Ables ..... 84/325
4,617,851 A * 10/1986 Sato ..... 84/622
4,622,627 A * 11/1986 Rodriguez et al. ..... 363/37
4,636,740 A * 1/1987 Kager ..... 330/123
5,267,134 A * 11/1993 Banayan ..... 363/40
5,459,283 A * 10/1995 Birdwell, Jr. ..... 84/737
5,589,760 A * 12/1996 Lee ..... 323/247
6,686,530 B2 * 2/2004 Juszkiewicz et al. ..... 84/600
6,956,353 B1 * 10/2005 Klitzner ..... 320/107
7,514,626 B1 * 4/2009 Snyder ..... 84/733
7,820,904 B1 * 10/2010 Robling et al. ..... 84/746
8,242,346 B2 * 8/2012 Haddad ..... 84/724
2005/0089175 A1 * 4/2005 Van Tassel ..... 381/63
2006/0037461 A1 * 2/2006 Yasumura ..... 84/730
2009/0282967 A1 * 11/2009 Skillings ..... 84/742
2009/0294320 A1 * 12/2009 Wolf et al. ..... 206/486
2010/0269670 A1 * 10/2010 O'Connor et al. ..... 84/626
2011/0061517 A1 * 3/2011 Haddad ..... 84/724
2011/0209598 A1 * 9/2011 Millar ..... 84/723
2011/0265635 A1 * 11/2011 Haddad ..... 84/724
2012/0036983 A1 * 2/2012 Ambrosino ..... 84/731
2012/0234161 A1 * 9/2012 Haddad ..... 84/724
2012/0304848 A1 * 12/2012 Haddad ..... 84/724
2013/0014632 A1 * 1/2013 Han ..... 84/723

* cited by examiner

*Primary Examiner* — David S. Warren
(74) *Attorney, Agent, or Firm* — IP & T Group LLP

(57) ABSTRACT

Disclosed herein is a power supply device for supplying power to a pickup device for a guitar. The pickup device includes a battery casing detachably provided with a battery for supplying power to a pickup unit and a TRS connector configured such that signal lines are connected thereto. The power supply line of the battery is connected in parallel to two of the signal lines between the battery casing and the TRS connector. The power supply device includes a pickup connector connected to the TRS connector, an external device connector connected to an external device, and a step-down transformer configured to step down commercial power and supply the stepped-down power to the pickup device via the TRS connector.

4 Claims, 3 Drawing Sheets

POWER SUPPLY DEVICE FOR GUITAR

CROSS-REFERENCE TO RELATED APPLICATIONS

The present application claims priority of Korean Patent Application No. 10-2011-0069512, filed on Jul. 13, 2011, which is incorporated herein by reference in its entirety.

BACKGROUND OF THE INVENTION

1. Field of the Invention

The present invention relates generally to a power supply device for a guitar and, more particularly, to a power supply device for a guitar that is capable of smoothly supplying the requisite power to a pickup that detects the mechanical vibrations of a guitar and converts the vibrations into electrical signals.

2. Description of the Related Art

A device that functions as a transducer for detecting the mechanical vibrations of a musical instrument and converting the vibrations into electrical signals is referred to as a "pickup." After the vibrations have been converted into electrical signals as described above, the electrical signals may be amplified or recorded.

A pickup device, as shown in FIG. 1, includes a pickup unit 110 configured to convert mechanical vibrations into electrical signals, a connector unit 120 configured such that signal lines for transmitting the electrical signals obtained by the pickup unit 110 to an external mixer, amp, recorder or electronic medium (hereinafter referred to as the "external device") are connected thereto, and a battery casing 130 configured to supply power to the pickup unit 110.

The pickup device can operate only when the battery casing 130 (which is configured to supply power to the pickup unit 110) is included and also a battery is installed in the battery casing 130.

An expensive alkaline battery is commonly used as the battery that is installed in the battery casing 130. The battery should be always charged sufficiently with power because music being played cannot be transmitted to the outside when the battery is not sufficiently charged with power. Therefore, even when power remains in the battery, the battery should be replaced with a new battery for a long period performance. As a result, problems arise in that batteries are unnecessarily wasted and also an environment is contaminated with the batteries.

SUMMARY OF THE INVENTION

Accordingly, the present invention has been made keeping in mind the above problems occurring in the prior art, and an object of the present invention is to provide a power supply device for a guitar that is configured to supply power to a pickup device using external commercial power.

In particular, an object of the present invention is to provide a power supply device for a guitar, in which a voltage converter is installed in a pickup device, so that even when external commercial power is input without change, it can be converted into the voltage and current suitable for the pickup device and can then be provided to electrical devices including the pickup device, thereby overcoming the problem of having to frequently replace the battery and problems associated therewith.

In order to accomplish the above object, the present invention provides a power supply device for supplying power to a pickup device for a guitar, the pickup device including a battery casing detachably provided with a battery for supplying power to a pickup unit and a TRS connector configured such that signal lines are connected thereto, wherein a power supply line of the battery is connected in parallel to two of the signal lines between the battery casing and the TRS connector; the power supply device including a pickup connector connected to the TRS connector; an external device connector connected to an external device; and a step-down transformer configured to step down commercial power and supply the stepped-down power to the pickup device via the TRS connector.

The power supply device may further include a balancer installed between the pickup connector and the external device connector and configured to convert unbalanced signals output from the pickup device into balanced signals. The step-down transformer may include a first step-down transformer for stepping down external commercial power and a second step-down transformer for stepping down power supplied from a phantom power supply. Any one of output powers stepped down by the above step-down transformer may be supplied to the pickup connector.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
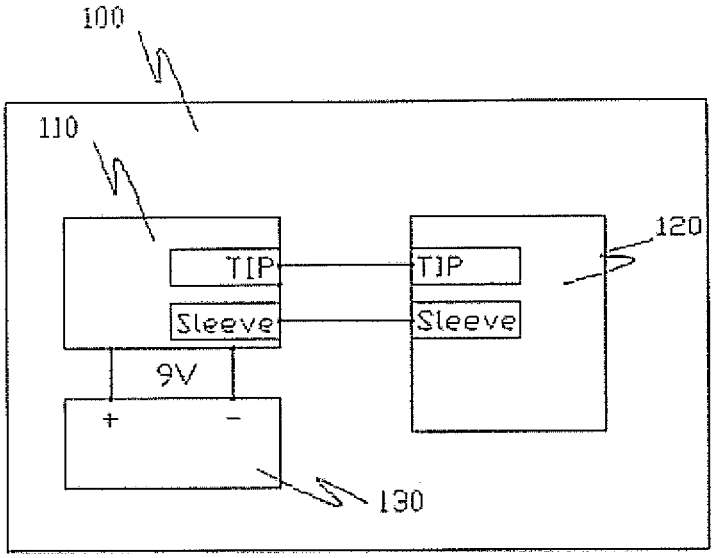
FIG. 1 is a diagram showing the configuration of a conventional pickup device.

Reference now should be made to the drawings, throughout which the same reference numerals are used to designate the same or similar components.

Power supply devices for a guitar according to embodiments of the present invention will be described in detail below with reference to the accompanying drawings.

These power supply devices for a guitar according to the present invention are configured to supply power to a pickup device without using a battery, and are intended to overcome worrying about a battery being insufficiently charged and problems attributable to the frequent replacement of the battery. The present invention provides a power supply device which supplies power to a pickup device for a guitar, the pickup device including a battery casing 130 detachably provided with a battery for supplying power to a pickup unit 110 and a TRS connector 120 configured such that signal lines are connected thereto, wherein a power supply line of the battery is connected in parallel to two of the signal lines between the battery casing 130 and the TRS connector 120; the power supply device including a pickup connector 11 connected to the TRS connector 120; an external device connector 13 connected to an external device; and a step-down transformer 12 configured to step down commercial power and supply the stepped-down power to the pickup device 100 via the TRS connector 13.

Figure 2:
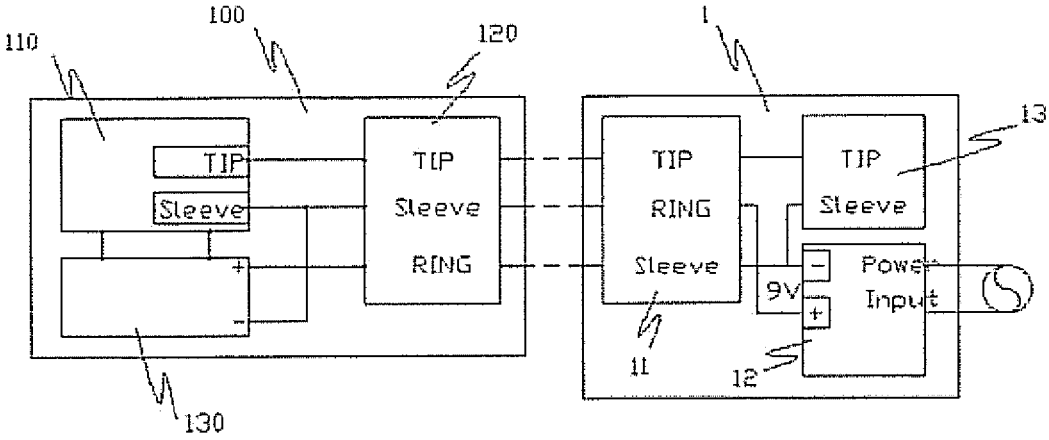
FIG. 2 is a diagram showing the configuration of a power supply device according to an embodiment of the present invention.
Figure 3:
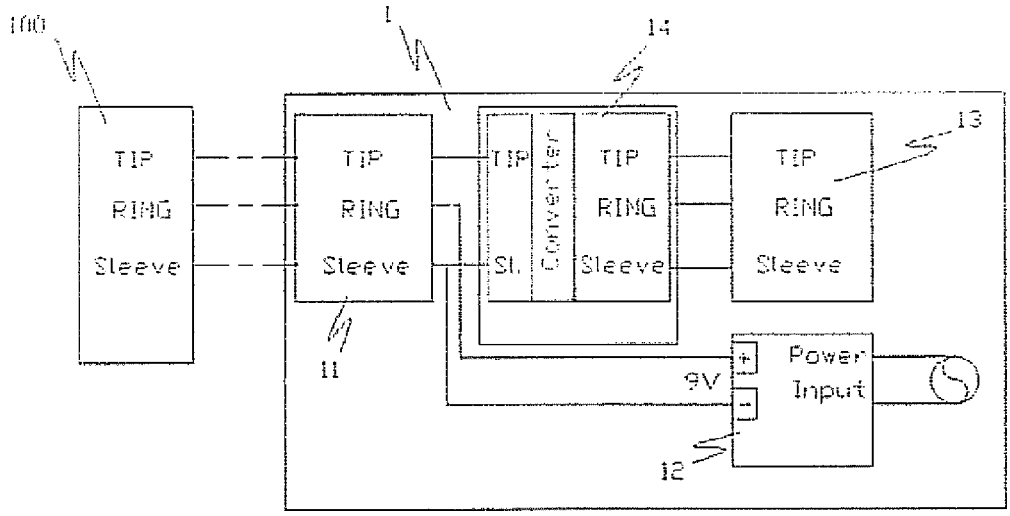
FIG. 3 is a diagram showing the configuration of a power supply device according to another embodiment of the present invention.
Figure 4:
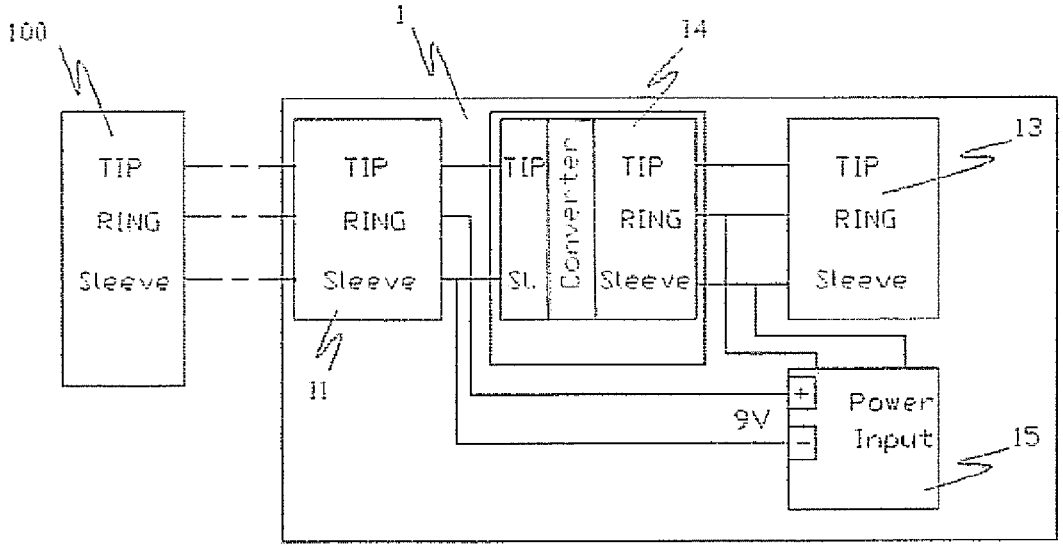
FIG. 4 is a diagram showing the configuration of a power supply device according to still another embodiment of the present invention.

A TRS connector may be used as the pickup connector 11, as shown in FIGS. 2 to 4. A connector may be selected from among commonly used connectors, and then be used as the TRS connector. One or more lines may be selected from among the lines connected to the connector, and then be used as power supply lines.

When the length of a cable connected to the mixer is above 10 m, noise may be easily introduced because signals that are transmitted to the outside via the TRS connector 120 and the pickup connector 11 are unbalanced. Accordingly, it is preferable to further install a balancer 14 between the pickup connector 11 and the external device connector 13 and convert unbalanced signals into balanced signals.

The balancer 14 may be formed of a device that is commonly called a DI box.

A TS connector may be used as the external device connector 13, as shown in FIG. 2, and a TRS connector may be used as the external device connector 13, as shown in FIGS. 3 and 4. An external mixer, an amp, a sound system or a computer may be connected to the external device connector 13.

Although a variety of step-down transformers may be used as the step-down transformer, the step-down transformer is a converter that steps down the power of a phantom power supply provided in a common guitar or commercial power (110-220 V) to a voltage suitable for the pickup device and then supplies the power that is suitable for the pickup device to the pickup device. That is, the step-down transformer may be formed of only a first step-down transformer 12 for stepping down commercial power, as shown in FIGS. 2 and 3, or may step down and convert 48 V power provided by an external phantom power supply and provide resulting power to the pickup device, as shown in FIG. 4.

The phantom power supply is commonly used to enable a capacitor microphone to be used in a mixer that is used for the sake of performance. When the power of the phantom power supply is supplied to the pickup device, making the connection to the phantom power supply can be significantly more convenient than making a connection to a commercial power source.

As described above, power can be more easily supplied to the pickup device using a phantom power supply rather than a commercial power source, and therefore the present invention may be provided with a second step-down transformer 15 for stepping down the output power of phantom power. The phantom power supply is a widely used power supply device. The phantom power supply is supplied with power via the external device connector 13. The supplied power is 48 V, and the output power of the phantom power supply may be 9 V which is the voltage used by a common pickup device. Since a phantom power supply that is being used currently may be selected and adopted as described above, a detailed description thereof will be omitted. It is preferable to further include a switching unit 16 in order to select power output from the first or second step-down transformer 12 or 15 and supply the power to the TRS connector 12.

Figure 5:
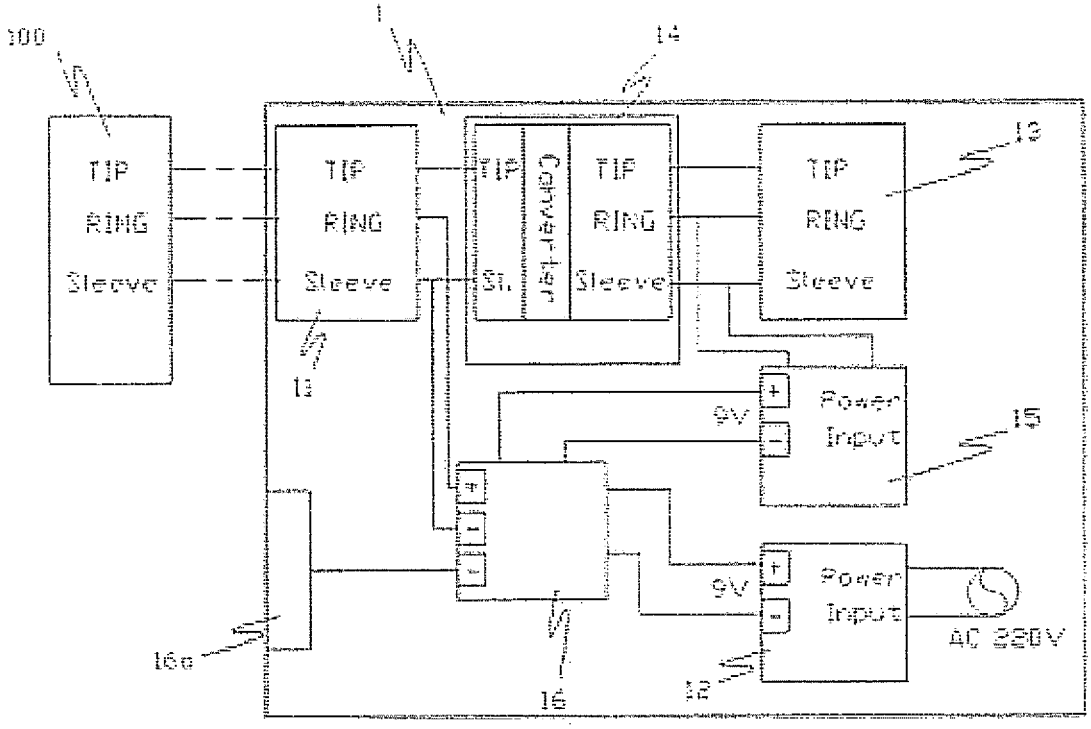
FIG. 5 is a diagram showing the configuration of a power supply device according to yet another embodiment of the present invention.

The switching unit 16 is means for performing switching when power is supplied from any one of the two transformers 12 and 15 so that the power can be supplied to the pickup device. Although it is preferred that the switching unit 16 be able to automatically detect the operation of the two transformers and perform switching, it may be possible to install an additional switch **16*a* on the outside of the power supply device 1 so that a user can freely perform switching, as shown in FIG. 5**.

It will be apparent that a mixer for supplying phantom power should be provided so that power can be supplied to the pickup device using the phantom power supply.

The power supply device for a guitar according to the present invention may be used such that the power stepped down by the two step-down transformers 12 and 15 is supplied both to the pickup device and to the battery casing, thereby charging a battery with power, as shown in the drawing. Here, it will be apparent that the battery installed in the battery casing should be a rechargeable battery.

According to the present invention, part of a pickup device provided in an existing musical instrument is modified so that commercial power can be directly supplied to the pickup device of the musical instrument and operate the pickup device, and therefore the mechanical vibrations of the musical instrument can be converted into electrical signals and then output to an external device without the use of a battery.

Accordingly, the prevent invention is advantageous in that the frequent replacement of a battery attributable to the use of the battery and the contamination of an environment attributable to the replacement of the battery can be prevented.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A power supply device for supplying power to a pickup device for a guitar, the pickup device including a battery casing detachably provided with a battery for supplying power to a pickup unit and a TRS connector configured such that signal lines are connected thereto, wherein a power supply line of the battery is connected in parallel to two of the signal lines between the battery casing and the TRS connector; the power supply device comprising:

a pickup connector connected to the TRS connector;

an external device connector connected to an external device;

a step-down transformer configured to step down commercial power and supply the stepped-down power to the pickup device via the TRS connector; and a switching unit disposed at output terminals of the first and second step-down transformers and configured to supply any one of output powers to the pickup connector, wherein the step-down transformer comprises a first step-down transformer for stepping down external commercial power and a second step-down transformer for stepping down power supplied from a phantom power supply.

2. The power supply device of claim 1, further comprising a balancer installed between the pickup connector and the external device connector and configured to convert unbalanced signals output from the pickup device into balanced signals.

3. The power supply device of claim 2, wherein the switching unit further comprises a switch that is exposed to an outside and is operated by a user.

4. The power supply device of claim 1, wherein the switching unit further comprises a switch that is exposed to an outside and is operated by a user.

* * * * *